US009079695B1

(12) United States Patent
Bennett

(10) Patent No.: US 9,079,695 B1
(45) Date of Patent: Jul. 14, 2015

(54) SELF-VACUUMIZING CONTAINER FOR BIO-ACTIVATED PROTECTIVE COMPOSITIONS

(71) Applicant: Phitech, LLC, Brooksville, FL (US)

(72) Inventor: Charles E. Bennett, Brooksville, FL (US)

(73) Assignee: Phitech, LLC, Brooksville, FL (US)

( * ) Notice: Subject to any disclaimer, the term of this patent is extended or adjusted under 35 U.S.C. 154(b) by 193 days.

(21) Appl. No.: 13/945,427

(22) Filed: Jul. 18, 2013

Related U.S. Application Data

(60) Provisional application No. 61/678,878, filed on Aug. 2, 2012.

(51) Int. Cl.
*B65D 53/00* (2006.01)
*B65D 43/02* (2006.01)

(52) U.S. Cl.
CPC ..... *B65D 53/00* (2013.01); *B65D 43/0214* (2013.01)

(58) Field of Classification Search
CPC ..... B65D 45/32; B65D 43/06; B65D 43/02; B65D 43/0216; B65D 43/0214; B65D 43/0202
USPC ..... 220/203.12, 203.11, 203.01, 304, 795, 220/780, 785, 784; 277/647, 644, 628
See application file for complete search history.

(56) References Cited

U.S. PATENT DOCUMENTS

| | | | | | |
|---|---|---|---|---|---|
| 668,501 | A | * | 2/1901 | Davis | 215/355 |
| 2,019,376 | A | * | 10/1935 | Wilhelm | 220/795 |
| 2,404,409 | A | * | 7/1946 | Smith | 215/352 |
| 3,380,621 | A | * | 4/1968 | Rissberger, Jr. et al. | 220/203.1 |
| 5,163,576 | A | * | 11/1992 | Galer | 220/792 |

* cited by examiner

*Primary Examiner* — Robert J Hicks
(74) *Attorney, Agent, or Firm* — Nilay J. Choksi; Smith & Hopen, P.A.

(57) ABSTRACT

An O-ring with elliptical cross-section disposed within a gasket seat about a cylindrical housing that contains a bio-activated protective composition. When sealed off from the environment, the bio-activated protective composition undergoes a self-vacuumizing process and requires the flow of gas. The elliptical cross-section of the O-ring is received within a recess of a housing cover to define a channel between the housing cover and the housing. This channel allows the gas to be released and prevents deformation of the O-ring regardless of mechanical compression, atmospheric pressure and temperature.

9 Claims, 7 Drawing Sheets

SELF-VACUUMIZING CONTAINER FOR BIO-ACTIVATED PROTECTIVE COMPOSITIONS

BACKGROUND OF THE INVENTION

1. Field of the Invention

This invention relates, generally, to gaskets for containers. More particularly, it relates to an O-ring gasket that soft seals a container and allows gas to escape from the contents of the container.

2. Description of the Prior Art

O-rings used as gaskets or seals for containers are known in the art. However, O-rings are typically used only as seals to prevent any air or gas from entering the container that it is being used to seal, rather than also as mechanisms by which air or gas can escape the container. Additionally, conventional O-rings have a circular cross-section and are thus prone to deformation when they are mechanically compressed or when a force, such atmospheric pressure, is applied to them. This deformation compromises the seal and allows unwanted gas to infiltrate the container and potentially alter the substance within the container.

Accordingly, what is needed is an O-ring that withstands deformation and allows the escape of gas from within a container of which the O-ring is supporting the seal. However, in view of the art considered as a whole at the time the present invention was made, it was not obvious to those of ordinary skill how the art could be advanced.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The long-standing but heretofore unfulfilled need for an improved, multi-functional and non-deforming O-ring gasket is now met by a new, useful and nonobvious invention.

In an embodiment, the current invention includes an O-ring construction that allows the escape of gas during a self-vacuumizing process of a bio-activated protective composition. The embodiment includes an O-ring that has an annular configuration about a housing. The housing has a cylindrical shape, so the O-ring is snugly fitted about the housing. The O-ring has an elliptical cross-section with an inner segment contained within a gasket seat in the housing and an outer segment contained within a recess of a housing cover. This enclosure defines a channel between the housing and the housing cover, thus allowing gas to enter and escape, as needed, during the self-vacuumizing process. The gasket seat protects the O-ring from deformation.

The O-ring may be constructed out of neoprene.

The gasket seat includes a vertical back, a first substantially horizontal flange disposed in overlying relation to the O-ring, and a second substantially horizontal flange disposed in underlying relation to the O-ring. The first and second flanges may be angled acutely toward the vertical center of the back support and thus contact the O-ring on the end of the O-ring distal to the back support.

In a separate embodiment, the current invention comprises an assembly of three components. The first component includes a housing with cylindrical shape. The housing has an impermeable base, upright wall, open top, and a gasket seat close to the open top. The housing contains a bio-activated composition that is capable of undergoing a self-vacuumizing process. The second component includes a housing cover that has a cylindrical shape with impermeable top, upright wall, an open bottom, and a cover seal extending vertically from the open bottom. The cover seal includes a recess adapted to receive the an outer segment of an elliptical O-ring. The third component includes the O-right with annular configuration and snugly fitted around said housing. The O-ring has an elliptical cross section that, when received within the recess of the cover seal, defines a channel between the housing and the housing cover. This channel allows gas to enter and escape during the self-vacuumizing process. The gasket seat protects the O-ring from deformation.

The O-ring may be constructed out of neoprene.

The gasket seat includes a vertical back, a first substantially horizontal flange disposed in overlying relation to the O-ring, and a second substantially horizontal flange disposed in underlying relation to the O-ring. The first and second flanges may be angled acutely toward the vertical center of the back support and thus contact the O-ring on the end of the O-ring distal to the back support.

In a separate embodiment, the current invention comprises a method of vacuumizing a bio-activated protective composition within a container. The method includes providing the housing with an impermeable base, a first cylindrical upright wall, an open top and a gasket seat close to the open top. A housing cover is provided with an impermeable top, a second cylindrical upright wall, an open bottom and a cover seal extending vertically from the open top. The cover seal includes a recess adapted to receive an outer segment of an elliptical O-ring. The O-ring is provided with an elliptical cross-section. The inner segment is contained within the gasket seat, and the outer segment is contained within the recess of the cover seal, as noted. This type of enclosure forms a channel between the housing cover and the housing, which, in turn, allows the flow of gas. The O-ring withstands deformation as a result of its elliptical cross-section and placement within the gasket seat. When the container is in a closed state, the composition undergoes a self-vacuumizing process and receives and exhausts gas. The channel allows the gas to escape from the container.

The O-ring may be constructed out of neoprene.

The gasket seat includes a vertical back, a first substantially horizontal flange disposed in overlying relation to the O-ring, and a second substantially horizontal flange disposed in underlying relation to the O-ring. The first and second flanges may be angled acutely toward the vertical center of the back support and thus contact the O-ring on the end of the O-ring distal to the back support.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The protective composition within an embodiment of the current invention includes natural washing, cleaning and feeding compositions. The composition can be a paste wax that is used to clean and buffer paint on any structure, such as an automobile. The composition remains an enzyme mixture until applied to the structure. When the composition is applied to the structure, oxygen from the air acts as a catalyst and allows the composition to bond to the surface of the structure.

As depicted in FIGS. 1A-4, the container enclosing the composition and protecting it from exposure to oxygen, among other natural elements, includes housing cover 14, O-ring 10 and housing 12. Housing cover 14 is characterized by high relative strength and designed to provide sufficient air capture while disposed in overlying and outer relation to O-ring 10 and housing 12, as seen in FIG. 1B. Housing 12 of the container has a size, shape and weight designed for ease of handling, convenient storage and protection of the enclosed composition. Housing 12 of the container has a closed bottom, an open mouth at the end opposite the closed bottom, and a uniform upright wall extending perpendicularly from the closed base and terminating at upper lip 16 of the open mouth.

Figure 1A:
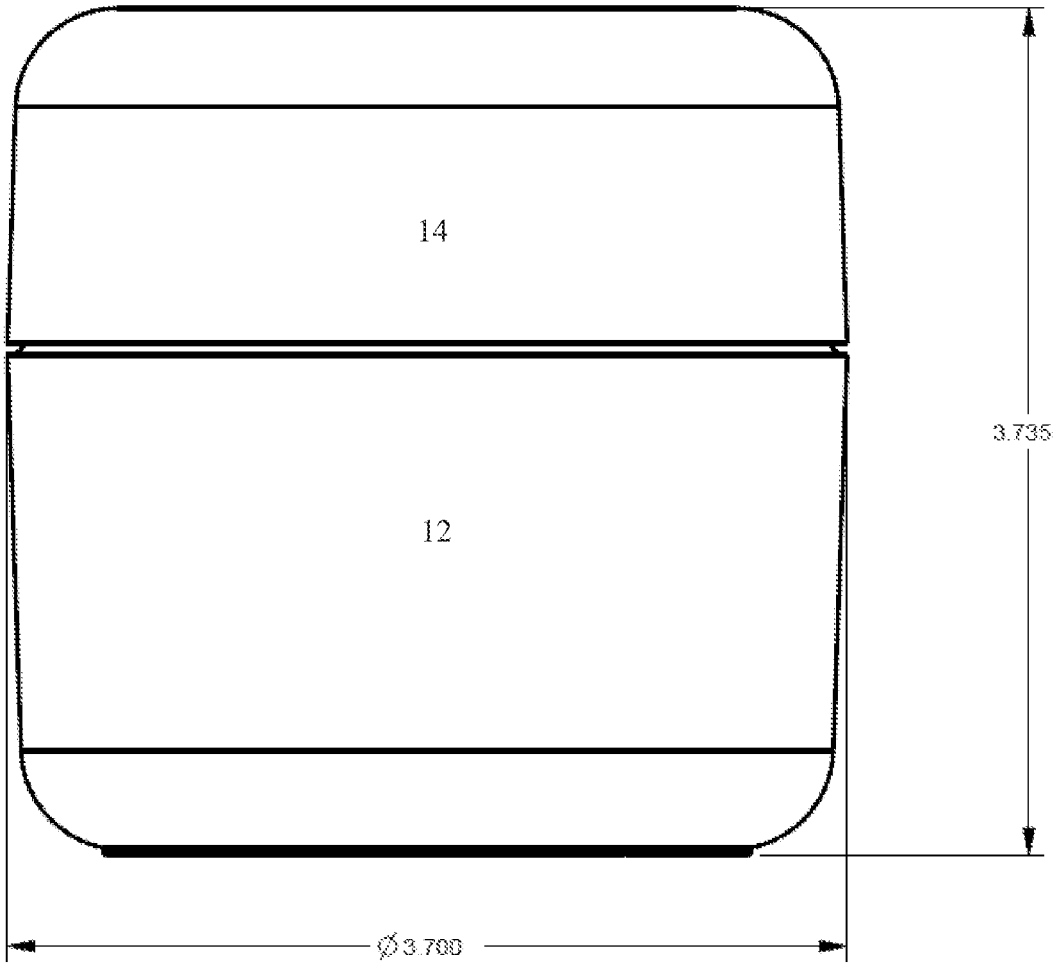
FIG. 1A is a side outer view of an assembly containing a housing, O-ring, and housing cover according to an embodiment of the current invention.
Figure 1B:
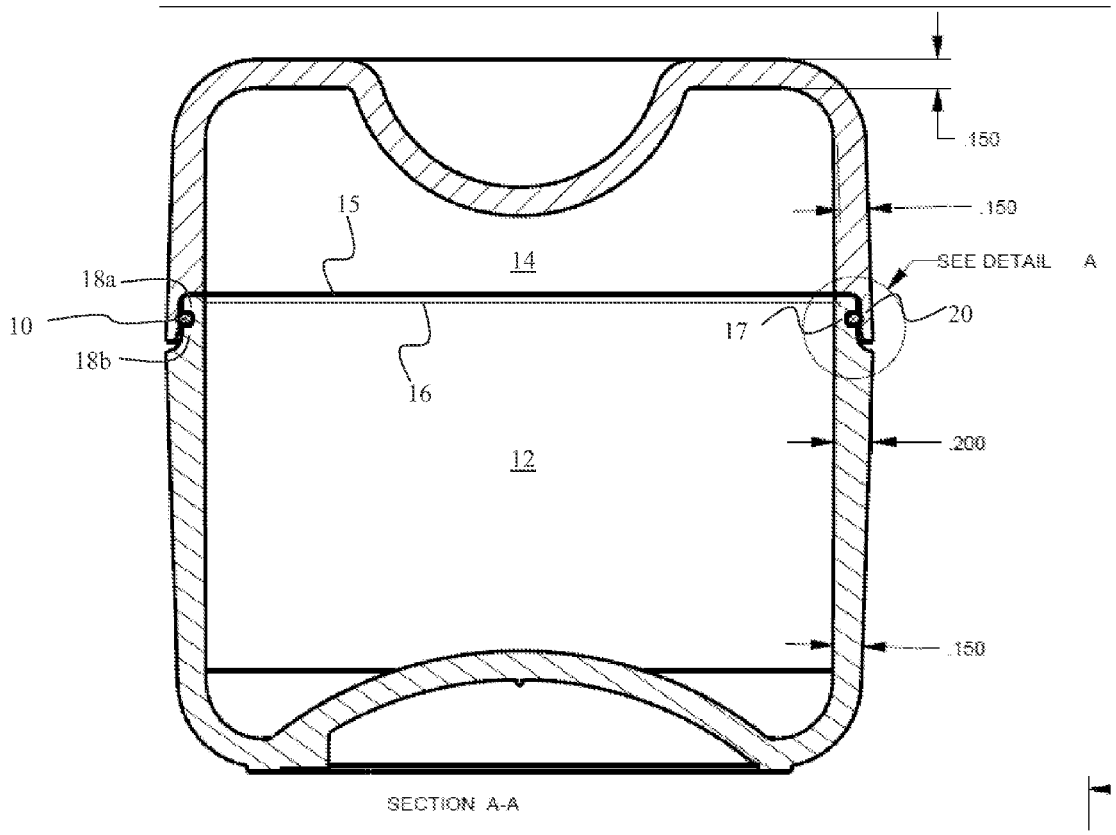
FIG. 1B is a side cross-sectional view of an assembly containing a housing, O-ring, and housing cover according to an embodiment of the current invention.
Figure 3:
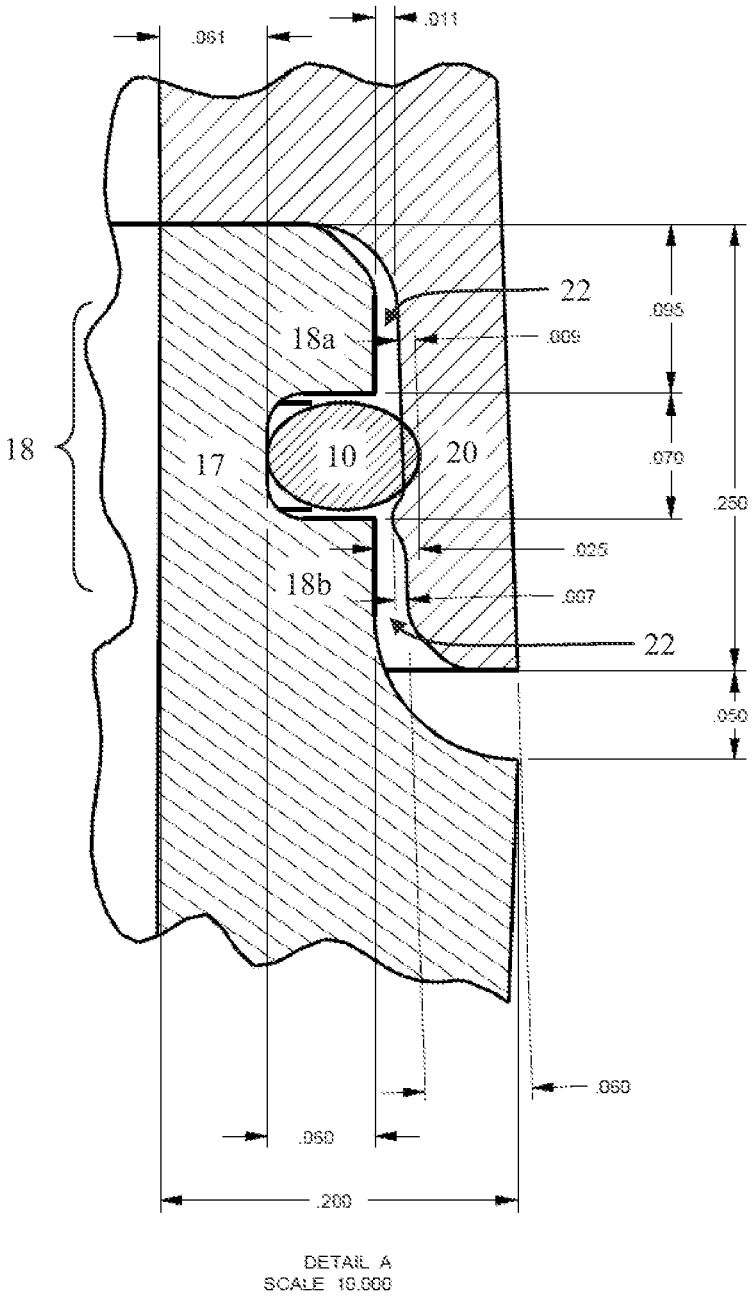
FIG. 3 is a close-up side cross-sectional view of an O-ring and gasket disposed on a housing according to an embodiment of the current invention.

As depicted in FIGS. 1B and 3, housing cover 14 includes cover seal 20 around its circumference and extending longitudinally from lower lip 15 of housing cover 14. Cover seal 20 includes a recess designed to receive O-ring 10 when a vertical force is applied to housing cover 14 to engage housing 12. When housing cover 14 has fully engaged housing 12, O-ring 10 fits snugly within the recess of cover seal 20. As such, the force applied to housing cover 14 must be applied until O-ring 10 is disposed within the recess of housing cover 14. Thus, O-ring 10 maintains the closed state of the container since the recess of housing cover 14 cannot be driven past O-ring 10. This is an improvement over the conventional art, which typically uses a screw top or matching threads or ribs and allows a user to apply too little pressure or apply excessive pressure. The present invention standardizes pressure since a user cannot apply too little or too much pressure to close the container.

Figure 4:
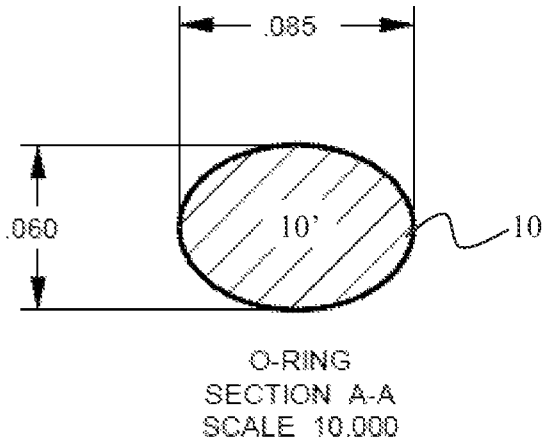
FIG. 4 is a cross-sectional view of an O-ring according to an embodiment of the current invention.

As depicted in FIG. 4, when O-ring 10 is disposed within the recess of cover seal 20 (i.e., container is in a closed state), channel 22 is created. Channel 22 between gasket seat 18 and cover seal 20 permits free airflow and allows the composition within the container to capture air to initiate a self-vacuumizing process. Because of the composition's bio-activation properties, capturing air during closing allows a top layer of the composition within the container to begin a self-vacuumizing process to preserve the composition.

The current invention includes O-ring 10 or torus of the container. While the assembly is in a closed state (i.e., O-ring 10 sits snugly within the recess of cover seal 20), as depicted in FIGS. 1B and 3, O-ring 10 is disposed under lower lip 15 of housing cover 14 and/or inside cover seal 20. O-ring 10 is a thin, flexible band in the general shape of the housing around which it is snugly fitted. In an embodiment, housing 12 can be a cylindrical enclosure, as depicted in FIGS. 1A-2B, so O-ring 10 would be a seal having an annular shape. O-ring 10 may be made of any suitable resilient material or solid elastomer, for example synthetic rubber, such as neoprene. The inner diameter of O-ring 10 is similar to the outer diameter of upper lip 16 of housing 12, so that O-ring 10 is disposed directly beneath upper lip 15 and within gasket seat 18.

Figure 2A:
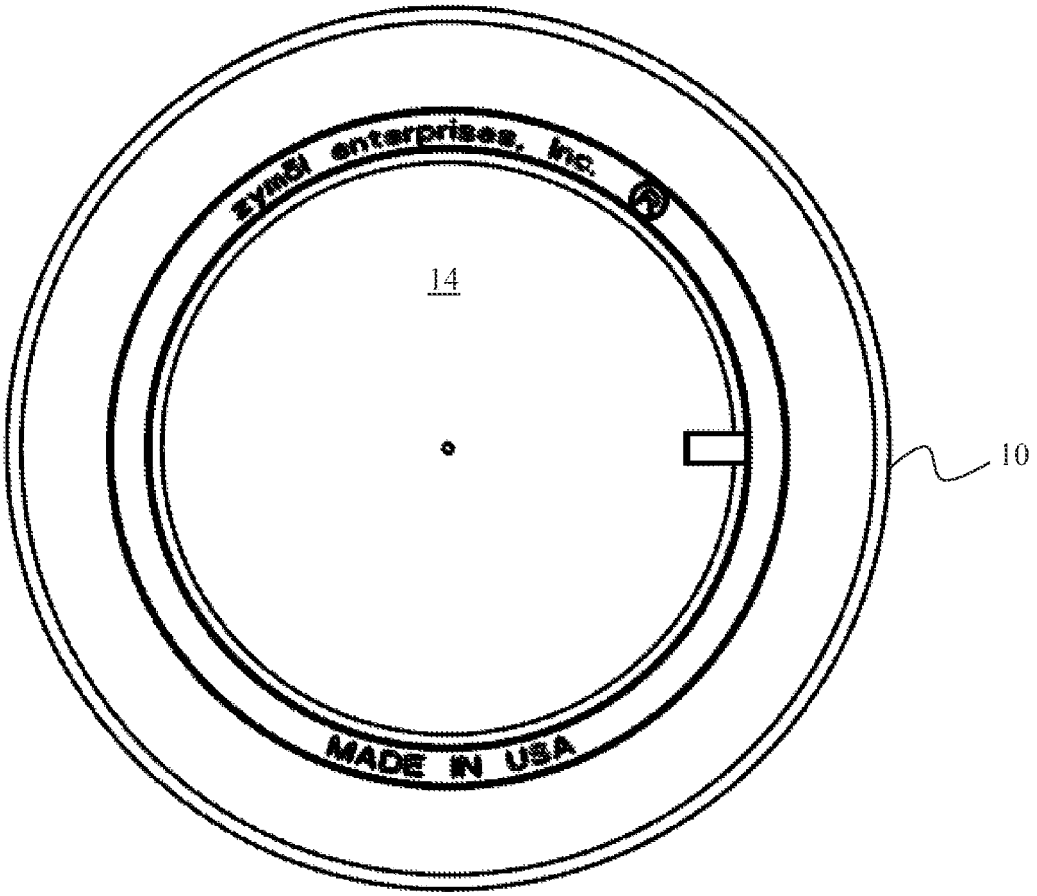
FIG. 2A is a top view of an assembly containing a housing, O-ring, and housing cover according to an embodiment of the current invention.
Figure 2B:
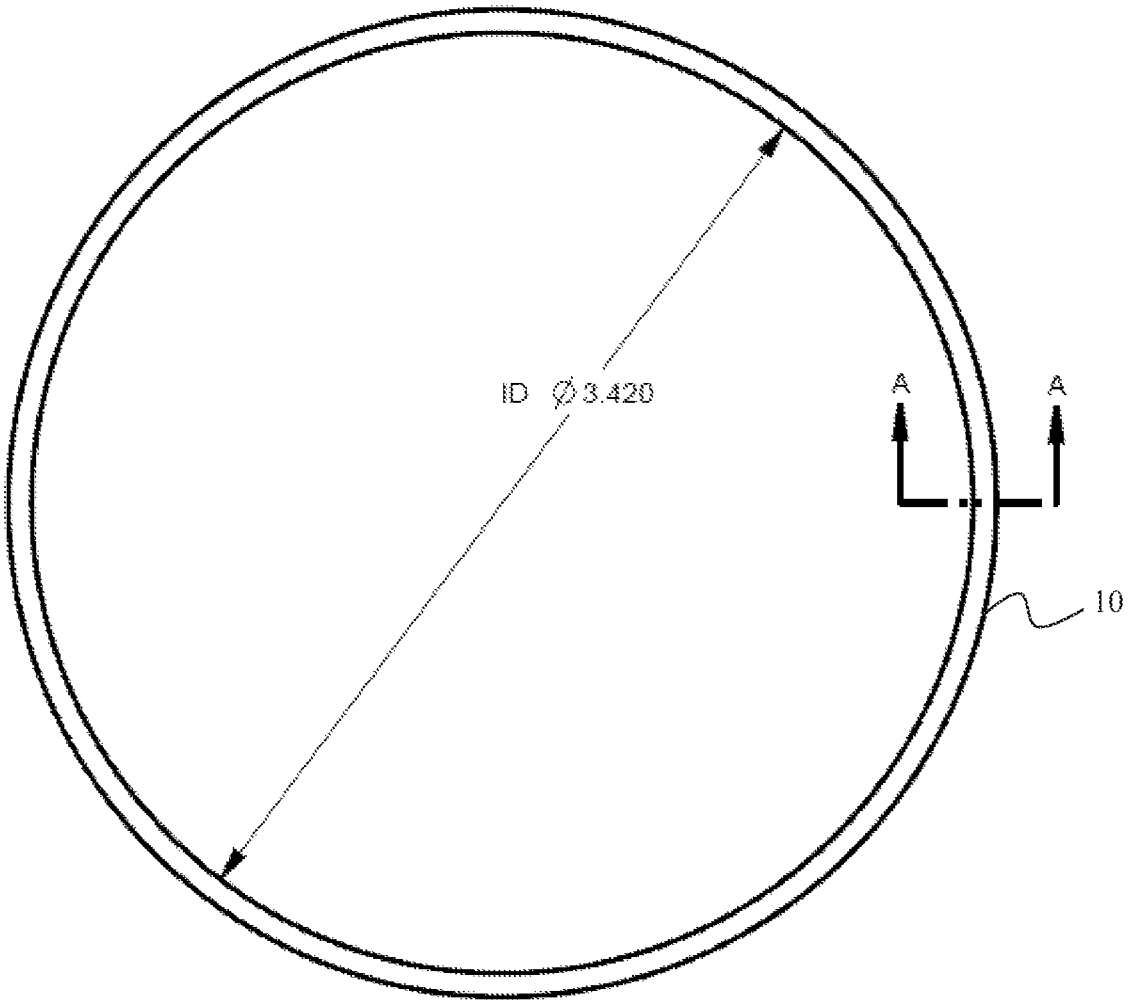
FIG. 2B is a top view of an O-ring according to an embodiment of the current invention.

FIGS. 2A and 2B depict top views of housing cover 14, showing O-ring 10 disposed along the outermost circumference of the container.

As seen in FIG. 3, housing cover 14 is placed above and/or around the circumference of upper lip 16 of housing 12 and secures housing 12 from unwanted contaminants. Cover seal 20 makes tangential contact with O-ring 10 on an outer side of O-ring 10, as O-ring 10 fits snugly within the recess of cover 20. O-ring 10 has elliptical cross-section 10' and overhangs flanges 18*a*, 18*b* of gasket seat 18. Thus, when an outer side of O-ring 10 is disposed within the recess of cover seal 20, channel 22 is left between cover seal 20 and flanges 18*a*, 18*b* which overlie and underlie O-ring 10, respectively. Flanges 18*a*, 18*b* and cover seal 20 are sufficiently distant from each other to seal from contamination but also allow gases to be captured and released during the self-vacuumizing process of the bio-activated composition enclosed within housing 12. This seal also prevents the entry of outside air due to increased external pressure after the gases have escaped housing 12 via channel 22 created by O-ring 10 and cover seal 20.

In an embodiment, as depicted in FIGS. 1B and 3, the invention includes gasket seat 18. Gasket seat 18 includes vertical back support 17 and two flanges 18*a*, 18*b*. Flange 18*a* extends in a generally horizontal direction from the top edge of back support 17. Flange 18*b* extends in a generally horizontal direction from the bottom edge of back support 17. Generally flanges 18*a*, 18*b* extend perpendicular to back support 17 and contact O-ring 10 on a top edge of O-ring 10 and on a bottom edge of O-ring 10, respectively.

Figure 5:
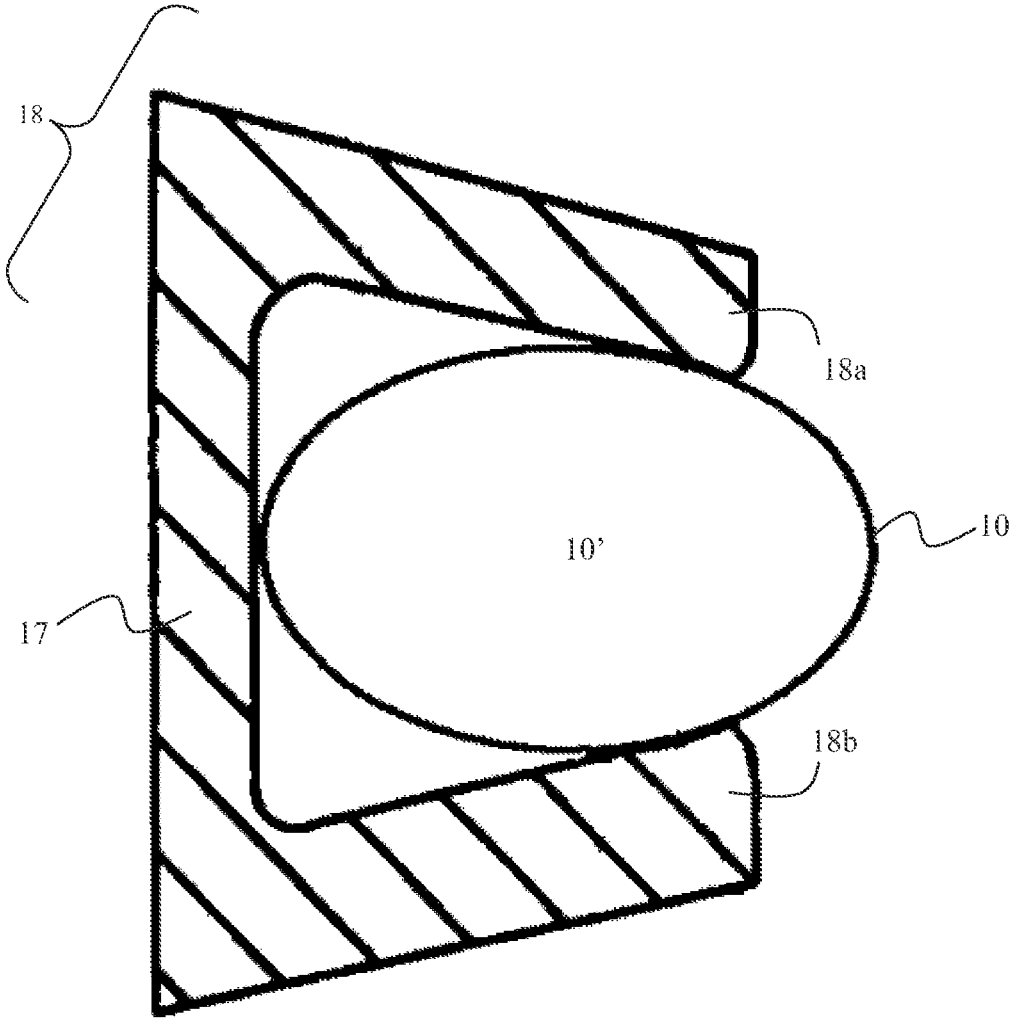
FIG. 5 is a close-up cross-sectional view of an O-ring with flanges disposed above and below the O-ring.

In an embodiment, as depicted in FIG. 5, flanges 18*a*, 18*b* are not perfectly perpendicular to back support 17 but are angled acutely toward the vertical center of vertical back support 17. O-ring 10 is disposed between flange 18*a* and flange 18*b*, such that flanges 18*a*, 18*b* make tangential contact with O-ring 10 on a side of O-ring 10 distal to vertical back support 17. This may help seal the container from unwanted contaminants.

As depicted in FIGS. 3-5, O-ring 10 has elliptical cross-section 10'. Elliptical cross-section 10' prohibits deformation of O-ring 10 within gasket seat 18 as pressure is applied from above and below O-ring 10. A more circular cross-section may be more prone to deformation if excessive pressure is applied, such that the O-ring might be squeezed out of its intended position, thereby compromising the seal that it is intended to provide. Elliptical cross-section 10' of O-ring 10 permits excessive force and maintains a continuous seal under all conditions. Additionally, elliptical cross-section 10' of O-ring 10 allows an outer portion of O-ring 10 to protrude from gasket seat 17 and fit snugly in the recess of cover seal 20.

Elliptical cross-section 10' of O-ring 10 also permits sufficient channel 22 between the edges of O-ring 10, gasket seat 18 and cover seal 20 to allow the escape of air or gas from housing 12. The elliptical surface of O-ring 10 has a smaller point of contact than conventional O-rings and thus enables non-deformation by allowing that point of contact to remain constant regardless of mechanical compression, atmospheric pressure or temperature. The constant point of contact allows O-ring 10 to act as a non-deforming relief valve since the longitudinal axis of O-ring 10 is substantially horizontal and the contact between cover seal 20 and O-ring 10 permits channel 22 between cover seal 20 and flanges 18*a*, 18*b*. Acting as a relief valve, O-ring 10 facilitates gas escape when the composition in housing 12 undergoes its self-vacuumizing process.

Glossary of Claim Terms

The term "angled acutely" as used herein refers to an angle less than 90° when measured against a reference. For example, a flange "angled acutely" toward the vertical center of a reference would have an angle less than 90° between the flange and the vertical center of the reference.

The term "annular" as used herein refers to a structure having the form of a ring. An "annular" structure has a hollow inner portion, though the thickness or height of the structure itself is not limited.

The term "back support" as used herein refers to a rigid component that prevents other structure from collapsing and is relatively "behind" the supported structures, such that the supported structures extend from the supporting structure. For example, a "back support" with two flanges prevents the two flanges from collapsing as the two flanges extend from the back support.

The term "bio-activated protective composition" as used herein refers to a substance that has protective qualities when applied to a structure and undergoes a biochemical alteration upon exposure to oxygen.

The term "channel" as used herein refers to any channel between two structures that permits the flow of a fluid (e.g., gas or liquid).

The term "cylindrical" as used herein refers to any structure having the shape of a cylinder, which includes a circular base, annular wall extending perpendicularly from the edges of the base, and a circular top at the point of termination of the wall.

The term "deformation" as used herein refers to a transformation or change of shape of a structure, thereby giving the structure an undesired shape.

The term "elliptical cross-section" as used herein refers to a cross-section of a structure having an ovular shape, or a closed curve with a first diameter larger than a second diameter that is perpendicular to the first diameter.

The term "flow" as used herein refers to receiving and/or freeing of a gas being introduced to or emitted from a composition undergoing a vacuumizing process.

The term "flange" as used herein refers to the projecting edge of a rigid component, the projecting edge intended to hold a structure in place. For example, "flanges" may extend from the opposite ends of a back support to hold an O-ring in place.

The term "force" as used herein refers to any physical quality that might have the ability to push, pull, twist or deform a structure. Examples of "forces" include mechanical compression and the results of atmospheric pressure and a change in temperature.

The term "fully engages" as used herein refers to the employment, utilization, meshing or interlocking of two structures. For example, a housing cover "fully engages" a housing by applying a force to the housing cover until an O-ring disposed within the housing contacts a recess in a cover seal extending from the housing cover.

The term "gas" as used herein refers to any exhaust emitted by a composition upon undergoing a chemical reaction. Thus, a bio-activated composition may receive and emit a "gas" upon undergoing its self-vacuumizing process.

The term "gasket seat" as used herein refers to a structure that can hold a gasket or seal in place without fully enclosing it. For example, a "gasket seat" may include flanges that are disposed in underlying relation and overlying relation to an O-ring to hold it in place without fully enclosing the O-ring.

The term "housing" as used herein refers to the container or covering of a composition. The closed sides of a "housing" are impermeable and protective of the composition within the housing.

The term "impermeable" as used herein refers to the characteristic of a structure to disallow the passage of a substance, such as water or gas. Thus, if walls of a container are "impermeable", the walls disallow the passage of a substance, such as water or gas.

The term "longitudinal section" as used herein refers to the part of a structure that runs in the direction of the long axis of the body of the structure. For example, the "longitudinal section" of an ellipse is the direction of the ellipse that has its largest diameter.

The term "O-ring" as used herein refers to a mechanical gasket that is used on containers to further seal the interior of the container from exterior fluid substances. An O-ring is not strictly limited to the shape of an "O".

The term "open" as used herein refers to not having an impermeable barrier disposed on that side of a structure. Thus, if a cylinder has an "open" top, then when the cylinder is positioned vertically, the top of the cylinder is hollow and does not contain and impermeable barrier.

The term "proximal" as used herein refers to one structure being near in channel to another structure. For example, when a gasket seat is in "proximal" relation to the upper lip of a housing, the gasket seat may be contiguous with the upper lip of the housing or may be located adjacent to the upper lip of the housing.

The term "recess" as used herein refers to any channel or indentation formed within a structure. Thus, a "recess" on the cover seal of a housing cover is an indentation adapted to snugly fit an O-ring disposed on or within the circumference of a housing.

The term "self-vacuumizing process" as used herein refers to a substance's ability to extinguish waste from itself in order to create a region of channel that contains no matter. This process, in turn, preserves the substance.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A closed container with O-ring construction that permits flow of gas during a self-vacuumizing process of a bio-activated protective composition disposed therein, comprising:

a housing having a cylindrical shape and an open top;

a gasket seat having a first substantially horizontal flange and a second substantially horizontal flange disposed about said housing proximal to said open top of said housing;

an O-ring having an elliptical cross-section that is substantially perpendicular to said housing, said O-ring having an inner segment of said elliptical cross-section and an outer segment of said elliptical cross-section;

said inner segment of said O-ring disposed within said gasket seat, said first flange of said gasket seat disposed in overlying relation to said inner segment and said second flange of said gasket seat disposed in underlying relation to said inner segment, said gasket seat maintaining constant contact with said inner segment to protect said O-ring from deformation when a downward or inward force is applied to said O-ring; and a housing cover having a cylindrical shape and an open bottom adapted to engage said open top of said housing, said housing cover having a cover seal extending longitudinally from said open bottom of said housing cover;

said cover seal having a recess adapted to receive said outer segment of said O-ring, said O-ring and said recess defining a channel between said cover seal and said first and second flanges, said channel sufficient to permit flow of said gas during said self-vacuumizing process.

2. A closed container as in claim 1, wherein said O-ring is constructed out of neoprene.

3. A closed container as in claim 1, wherein said first and second flanges are angled acutely toward a vertical center of said gasket seat.

4. An assembly for the utilization of a bio-activated protective composition, comprising:

a first component, said first component comprising:

a housing having a cylindrical shape with an impermeable base, a first impermeable annular wall extending perpendicularly from said impermeable base, and an open top, said housing containing said bio-activated protective composition, and a gasket seat disposed in proximal relation to said open top of said housing, said gasket seat having a back support, a first substantially horizontal flange and a second substantially horizontal flange;

a second component, said second component comprising:

an O-ring having an elliptical cross-section that defines an inner segment and an outer segment, said inner segment disposed within said gasket seat, said outer segment protruding from said gasket seat, said gasket seat protecting said O-ring from deformation when a force is applied to said O-ring; and a third component, said third component comprising:

a housing cover having a cylindrical shape with an impermeable top, a second impermeable annular wall extending perpendicularly from said impermeable top, an open base, and a cover seal extending vertically from said open base, said cover seal including a recess adapted to snugly receive said O-ring to define a channel between said cover seal and said first and second flanges, said channel allowing a gas to flow during a self-vacuumizing process of said bio-activated protective composition.

5. An assembly as in claim 4, wherein said O-ring is constructed out of neoprene.

6. An assembly as in claim 4, wherein said first and second flanges are angled acutely toward a vertical center of said back support.

7. A method of vacuumizing a bio-activated protective composition within a container, comprising the steps of:

providing a housing having an impermeable base, a first cylindrical upright wall, an open top and a gasket seat that has a first substantially horizontal flange and a second substantially horizontal flange, said gasket seat disposed in proximal relation to said open top;

providing an O-ring with elliptical cross-section that defines an inner segment and an outer segment, said inner segment disposed within said gasket seat;

providing a housing cover having an impermeable top, a second cylindrical upright wall, an open bottom and a cover seal extending vertically from said open bottom, said cover seal including a recess adapted to receive said outer segment of said O-ring;

applying a force onto said housing cover to engage said housing cover and said housing, wherein said force is applied until said outer segment of said O-ring is snugly enclosed within said recess of said cover seal to define a channel between said cover seal and said first and second flanges of said gasket seal, said channel permitting the flow of a gas for said composition to undergo said self-vacuumizing process.

8. A method as in claim 7, wherein said O-ring is constructed out of neoprene.

9. A method as in claim 7, wherein said gasket seat further includes a back support, wherein said first and second flanges are angled acutely toward a vertical center of said back support.

* * * * *